US007693264B2

(12) United States Patent
Gadre et al.

(10) Patent No.: US 7,693,264 B2
(45) Date of Patent: Apr. 6, 2010

(54) ANTECHAMBER CONTROL REDUCING LEAK THROUGH FERROFLUID SEALS

(75) Inventors: Aniruddha Gadre, Rexford, NY (US); Darren Lee Hallman, Clifton Park, NY (US); Paul M. Ratzmann, Germantown, WI (US); Richard Michael Roffers, Whitefish Bay, WI (US); John Scott Price, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 223 days.

(21) Appl. No.: 11/557,201

(22) Filed: Nov. 7, 2006

(65) Prior Publication Data

US 2008/0107236 A1 May 8, 2008

(51) Int. Cl.
*H01J 35/20* (2006.01)

(52) U.S. Cl. ..... 378/123; 378/125; 378/130; 378/132

(58) Field of Classification Search ..... 378/123, 378/125, 130–133, 144
See application file for complete search history.

(56) References Cited

U.S. PATENT DOCUMENTS

| | | | | |
|---|---|---|---|---|
| 3,256,439 | A * | 6/1966 | Dyke et al. | 378/102 |
| 4,865,334 | A * | 9/1989 | Raj et al. | 277/410 |
| 5,077,781 | A * | 12/1991 | Iversen | 378/200 |
| 5,340,122 | A * | 8/1994 | Toboni et al. | 277/410 |
| 2006/0034425 | A1 * | 2/2006 | Unger et al. | 378/125 |

* cited by examiner

*Primary Examiner*—Hoon Song
*Assistant Examiner*—Mona M Sanei
(74) *Attorney, Agent, or Firm*—Scott J. Asmus

(57) ABSTRACT

A system for controlling a gas load imposed upon a high vacuum chamber includes a first chamber enclosing a high vacuum and positioned within an ambient environment, a second chamber enclosing a gas and positioned within the ambient environment adjacent to the first chamber, and a rotatable shaft having a first portion extending into the first chamber and a second portion extending into the second chamber. A ferrofluid seal is positioned about the rotatable shaft and positioned between the first portion and the second portion and the ferrofluid seal fluidically separates the first chamber from the second chamber. A control unit is attached to the second chamber and configured to control the gas enclosed in the second chamber such that a gas load in the first chamber is reduced.

22 Claims, 5 Drawing Sheets

ANTECHAMBER CONTROL REDUCING LEAK THROUGH FERROFLUID SEALS

BACKGROUND OF THE INVENTION

The present invention relates generally to x-ray tubes and, more particularly, to reducing leak between x-ray tube chambers separated by a ferrofluid seal.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across an anode-to-cathode vacuum gap and produces x-rays upon impact with the anode. Because of the high temperatures generated when the electron beam strikes the target, it is necessary to rotate the anode assembly at high rotational speed. This places stringent demands on the bearing assembly, which typically includes tool steel ball bearings and tool steel raceways positioned within the vacuum region, thereby requiring lubrication by a solid lubricant such as silver. In addition, the rotor, as well, is placed in the vacuum region of the x-ray tube. Wear of the silver and loss thereof from the bearing contact region increases acoustic noise and slows the rotor during operation. Placement of the bearing assembly in the vacuum region prevents lubricating with wet bearing lubricants, such as grease or oil, and performing maintenance on the bearing assembly to replace the solid lubricant.

In addition, the operating conditions of newer generation x-ray tubes have become increasingly aggressive in terms of stresses because of g forces imposed by higher gantry speeds and higher anode run speeds. As a result, there is greater emphasis in finding bearing solutions for improved performance under the more stringent operating conditions.

Placing the bearing assembly and rotor outside the vacuum region of the x-ray tube by use of a hermetic rotating seal such as a ferrofluid seal allows the use of wet lubricants, such as grease or oil, to lubricate the bearing assembly. Coolant for the ferrofluid seal may serve as coolant for the conventional bearings. In addition, maintenance may be performed on the bearing assembly and rotor without interrupting the vacuum in the vacuum region. Enabling the use of conventional bearings brings other advantages. For instance, more conventional parts, bearing assemblies, tolerances, design options, and materials are available for selection during the design process.

A ferrofluid seal typically includes a series of annular regions between a rotating component and a non-rotating component. The annular regions are occupied by a ferrofluid that is typically a hydrocarbon-based or fluorocarbon-based oil with a suspension of magnetic particles therein. The particles are coated with a stabilizing agent, or surfactant, which prevents agglomeration of the particles in the presence of a magnetic field. When in the presence of a magnetic field, the ferrofluid is caused to form a seal between each of the annular regions. The seal on each annular region, or stage, can separately withstand pressure of typically 1-3 psi and, when each stage is placed in series, the overall assembly can withstand pressure varying from atmospheric pressure on one side to high vacuum on the other side.

The ferrofluid seal allows rotation of a shaft therein designed to deliver mechanical power from the rotor on one side of the seal to the anode on the other side. As such, the rotor may be placed outside the vacuum region to enable conventional grease-lubricated or oil-lubricated bearings to be placed on the same side of the seal as the rotor to support the target. Furthermore, such bearings may be larger than those typically used on the vacuum side.

While ferrofluid seals hermetically seal one side from the other, gas and water vapor may diffuse through the ferrofluid, the rates of which are governed by diffusion mass transport. Ionizable gases that transport through the seal, when exposed to the high voltage environment of an x-ray tube, lead to ionization failure of the x-ray tube. As such, the environmental conditions that exist on the higher pressure side of the ferrofluid seal influence the type of gas and the total gas load that is present on the vacuum side of the seal.

Therefore, it would be desirable to design an apparatus and method to reduce the gas load through a ferrofluid seal.

BRIEF DESCRIPTION OF THE INVENTION

The present invention provides a method and apparatus for improving an x-ray tube with a ferrofluid seal that overcomes the aforementioned drawbacks. A control unit is configured to control gas enclosed in a first chamber on one side of a ferrofluid seal to reduce the gas load in a second chamber on the other side of the seal.

According to one aspect of the present invention, a system for controlling a gas load imposed upon a high vacuum chamber comprises a first chamber enclosing a high vacuum and positioned within an ambient environment, a second chamber enclosing a gas and positioned within the ambient environment adjacent to the first chamber, and a rotatable shaft having a first portion extending into the first chamber and a second portion extending into the second chamber. A ferrofluid seal is positioned about the rotatable shaft and positioned between the first portion and the second portion and the ferrofluid seal separates the first chamber from the second chamber. A control unit is attached to the second chamber and configured to control the gas enclosed in the second chamber such that a gas load in the first chamber is reduced.

In accordance with another aspect of the invention, an x-ray tube comprises a vacuum enclosure having a high vacuum formed therein, an antechamber containing a gas, and a hermetic seal positioned between the vacuum enclosure and the antechamber. A rotatable shaft extends from within the vacuum enclosure and into the antechamber through the hermetic seal. A controller is fluidically connected to the antechamber and configured to adjust a pressure of the gas in the antechamber such that a gas load of the first enclosure is reduced.

Yet another aspect of the present invention includes a method of manufacturing an x-ray tube comprising the steps of providing a rotatable shaft, attaching an anode to a rotatable shaft, disposing the anode in a first volume, attaching a rotor and a bearing assembly to the rotatable shaft, disposing the rotor and bearing assembly in a second volume, attaching a ferrofluid seal assembly to the rotatable shaft, positioned between the first volume and the second volume and hermetically sealing the two volumes from one another, attaching a controller to the second volume, the controller configured to control a gas contained in the second volume in order to reduce a gas load on the first volume, and forming an ultra-high vacuum in the first volume.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention is described with respect to the use of an x-ray tube as used in a computed tomography (CT) system. However, it will be appreciated by those skilled in the art that the present invention is equally applicable for use in other systems that require the use of an x-ray tube. Such uses include, but are not limited to, x-ray imaging systems (for medical and non-medical use), mammography imaging systems, and radiographic (RAD) systems.

Moreover, the present invention will be described with respect to use in an x-ray tube. However, one skilled in the art will further appreciate that the present invention is equally applicable for other systems that require operation of a bearing in a high vacuum, high temperature, and high contact stress environment, wherein the life, reliability, or performance of the x-ray tube could benefit from placement of a bearing outside the vacuum region of the x-ray tube. The present invention will be described with respect to a "third generation" CT medical imaging scanner, but is equally applicable with other CT systems, such as a baggage scanner or a scanner for other non-destructive industrial uses.

Figure 1:
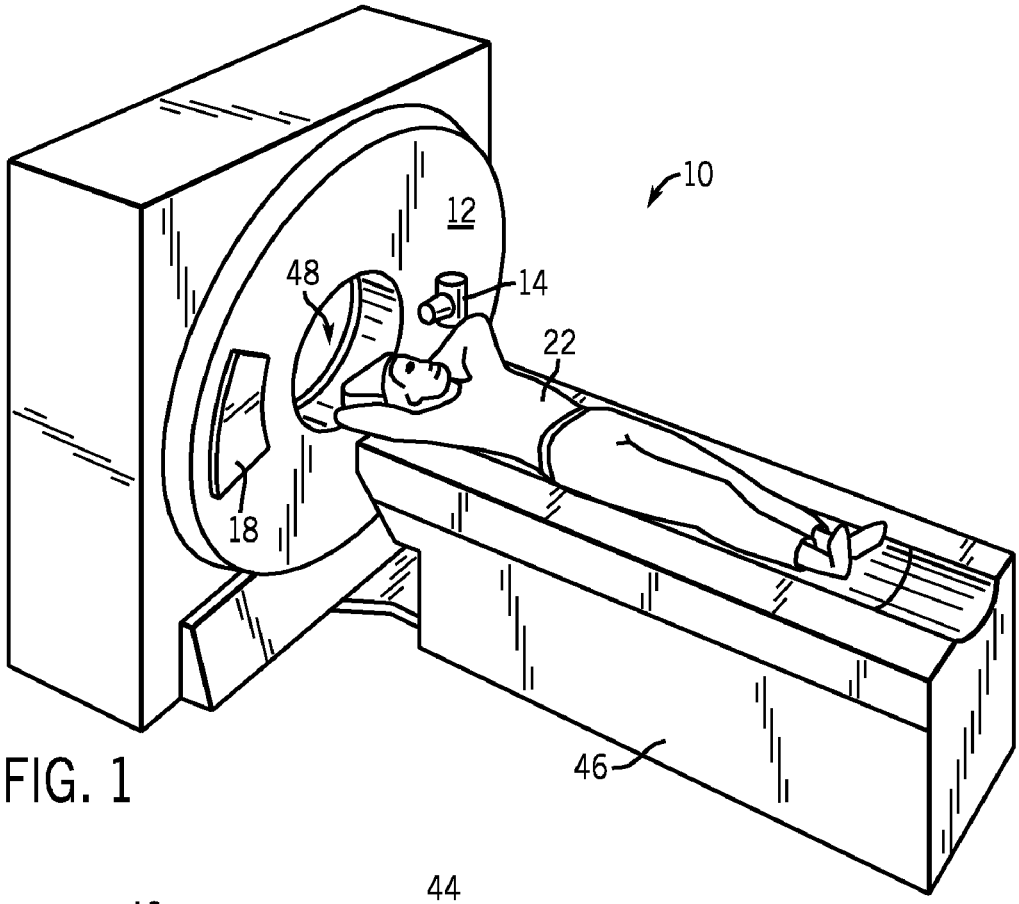
FIG. 1 is a pictorial view of a CT imaging system that can benefit from incorporation of an embodiment of the present invention.
Figure 2:
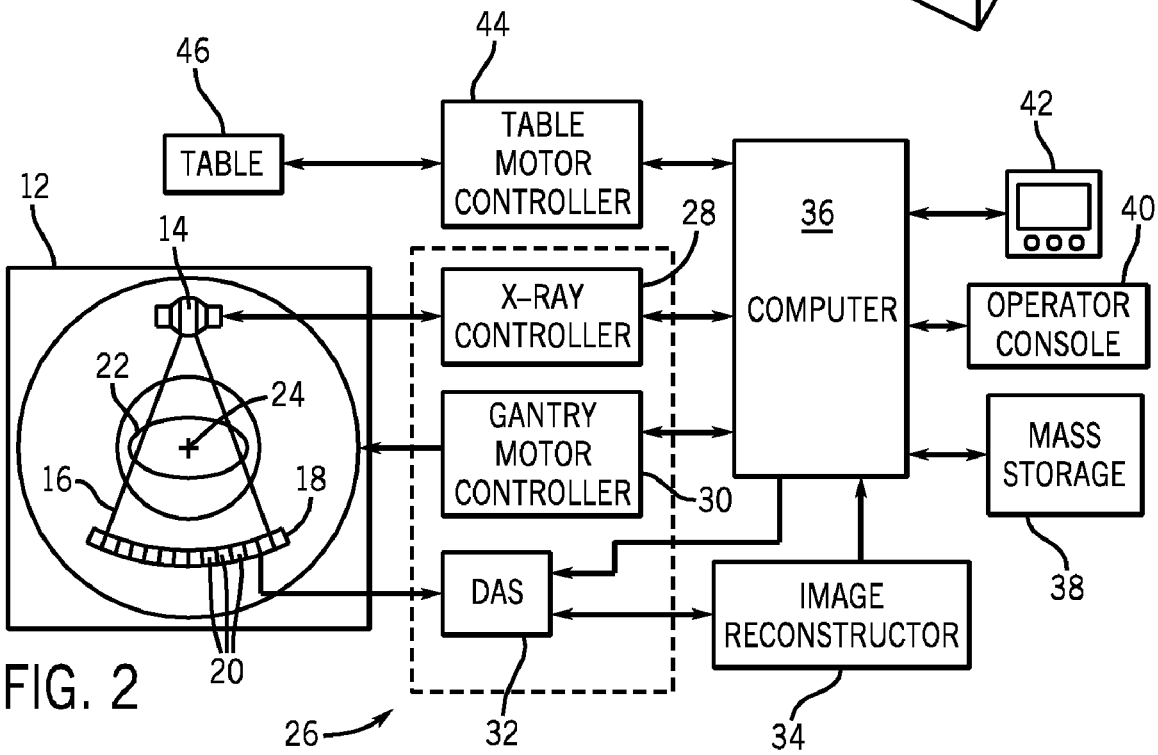
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray tube 14 that projects a beam of x-rays 16 toward a detector array 18 on the opposite side of the gantry 12. Detector array 18 is formed by a plurality of detectors 20 which together sense the projected x-rays that pass through a medical patient 22. Each detector 20 produces an electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray tube 14 are governed by a control mechanism 26 of CT system 10. Control mechanism 26 includes an x-ray controller 28 that provides power and timing signals to an x-ray tube 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves portions of patient 22 through a gantry opening 48.

Figure 3:
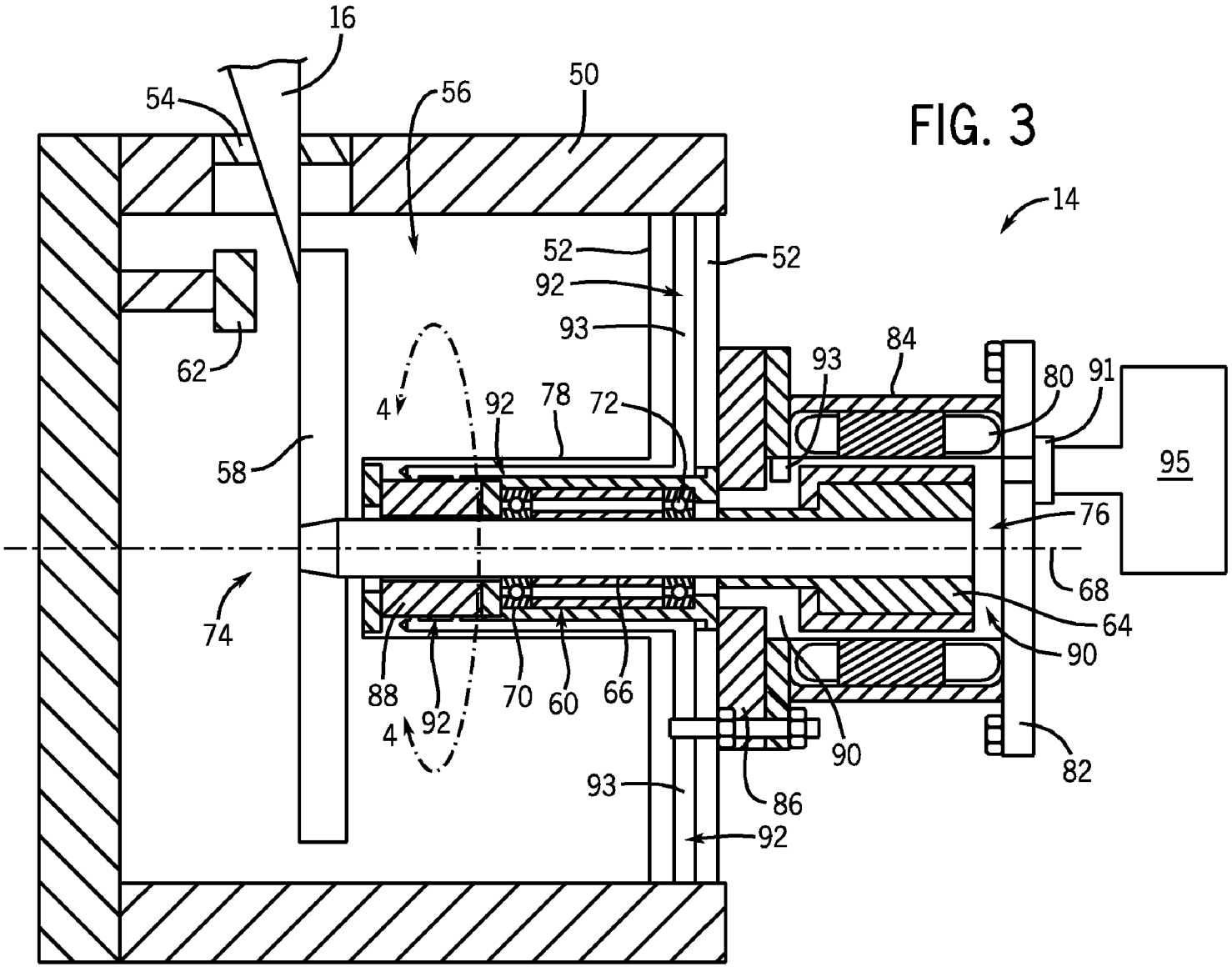
FIG. 3 illustrates a cross-sectional view of an x-ray tube that can benefit from incorporation of an embodiment of the present invention.

FIG. 3 illustrates a cross-sectional view of an x-ray tube 14 according to an embodiment of the present invention. The x-ray tube 14 includes a frame 50 and an anode backplate 52. A radiation emission passage 54 allows x-rays 16 to pass therethrough. Frame 50 and anode backplate 52 enclose an x-ray tube volume 56, which houses a target, or anode, 58, a bearing assembly 60, and a cathode 62. X-rays 16 are produced when high-speed electrons are suddenly decelerated when directed from the cathode 62 to the anode 58 via a potential difference therebetween of, for example, 60 thousand volts or more in the case of CT applications. The x-rays 16 are emitted through radiation emission passage 54 toward a detector array, such as detector array 18 of FIG. 2. To avoid overheating the anode 58 from the electrons, a rotor 64 and a center shaft 66 rotate the anode 58 at a high rate of speed about a centerline 68 at, for example, 90-250 Hz. Anode 58 is attached to center shaft 66 at a first end 74, and the rotor 64 is attached to center shaft 66 at a second end 76.

The bearing assembly 60 includes a front bearing 70 and a rear bearing 72, which support center shaft 66 to which anode 58 is attached. In a preferred embodiment, front and rear bearings 70, 72 are lubricated using grease or oil. Front and rear bearings 70, 72 are attached to center shaft 66 and are mounted in a stem 78, which is supported by anode backplate 52. A stator 80 rotationally drives rotor 64 attached to center shaft 66, which rotationally drives anode 58.

A mounting plate 82, a stator housing 84, a stator mount structure 86, stem 78, and a ferrofluid seal assembly 88 surround an antechamber 90 into which bearing assembly 60 and rotor 64 are positioned and into which the second end 76 of center shaft 66 extends. Center shaft 66 extends from antechamber 90, through ferrofluid seal assembly 88, and into x-ray tube volume 56. The ferrofluid seal assembly 88 hermetically seals x-ray tube volume 56 from antechamber 90. Cooling passage 92 carries coolant 93 through anode backplate 52 and into stem 78 to cool ferrofluid seal assembly 88 thermally connected to stem 78.

In addition to rotation of the anode 58 within x-ray tube 14, the x-ray tube 14 as a whole is caused to rotate about gantry 12 at rates of, typically, 1 Hz or faster. The rotational effects of both the x-ray tube 14 about the gantry 12 and the anode 58 within the x-ray tube 14 cause the anode 58 weight to be compounded significantly, hence leading to large operating contact stresses in the bearings 70, 72.

Figure 4:
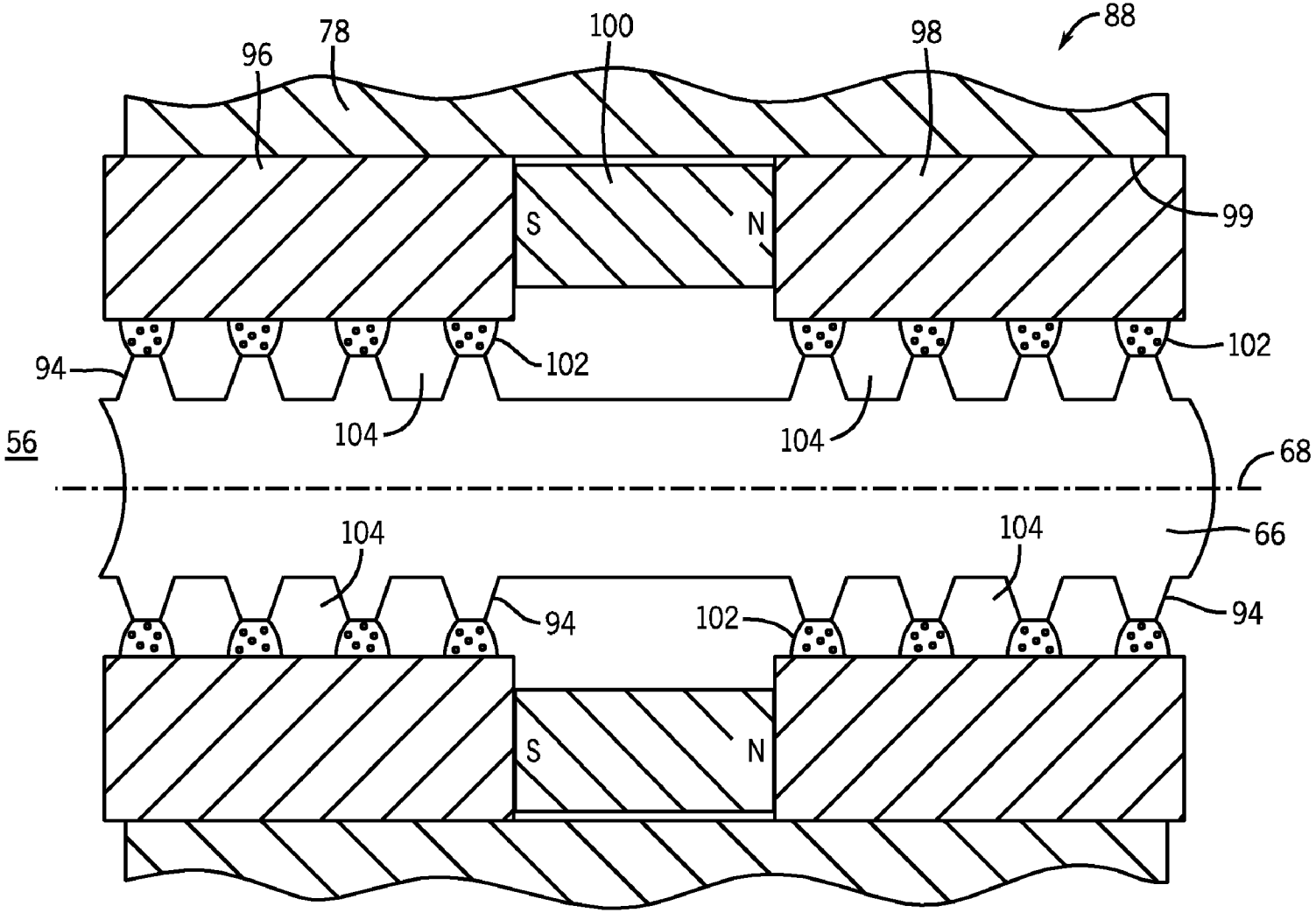
FIG. 4 illustrates a cross-sectional view of a ferrofluid seal assembly according to the present invention.

FIG. 4 illustrates a cross-sectional view of the ferrofluid seal assembly 88 of FIG. 3. A pair of annular pole pieces 96, 98 abut an interior surface 99 of stem 78 and encircle center shaft 66. An annular permanent magnet 100 is positioned between pole piece 96 and pole piece 98. In a preferred embodiment, center shaft 66 includes a annular rings 94 extending therefrom toward pole pieces 96, 98. Alternatively, however, pole pieces 96, 98 may include annular rings extending toward center shaft 66 instead of, or in addition to, annular rings 94 of center shaft 66. A ferrofluid 102 is positioned between each annular ring 94 and corresponding pole piece 96, 98, thereby forming cavities 104. Magnetization from permanent magnet 100 retains the ferrofluid 102 positioned between each annular ring 94 and corresponding pole piece 96, 98 in place. In this manner, multiple stages of ferrofluid 102 are formed that hermetically seal the pressure of gas in the antechamber 90 of FIG. 3 from a high vacuum formed in x-ray tube volume 56. As shown, FIG. 4 illustrates 8 stages of ferrofluid 102. Each stage of ferrofluid 102 withstands 1-3 psi of gas pressure. Accordingly, one skilled in the art will recognize that the number of stages of ferrofluid 102 may be increased or decreased, depending on the difference in pressure between the antechamber 90 and the x-ray tube volume 56.

Referring again to FIG. 3, the presence of gas or vapor in antechamber 90 may serve as a source which may leak or diffuse through the ferrofluid stages 102 (shown in FIG. 4) to x-ray tube volume 56. The gases in antechamber 90 may include air, water vapor, hydrocarbons, inert gases, and organic compounds, and the like, which may be present in the environment itself or may derive from contaminant atomic layers attached to the walls of antechamber 90. Such sources may be the result of inadequate cleaning of parts prior to processing of the x-ray tube 14, or from exposure of the parts during assembly and processing of the x-ray tube 14.

According to an embodiment of the present invention, the gas load which passes, or diffuses, from antechamber 90 through ferrofluid seal assembly 88 and into x-ray tube volume 56 is reduced by attaching a controller 95 to antechamber 90 via connection port 91, purging the antechamber 90 and backfilling a relatively inert gas, such as nitrogen, argon, and the like, into antechamber 90 during, or subsequent to, assembly and processing. Alternatively, dry air may be backfilled into antechamber 90. In addition to backfilling the antechamber 90 with an inert gas or dry air, a dessicant 93 may be placed in antechamber 90 such that any traces of water vapor present in the antechamber 90 are absorbed, thus reducing transfer of the water vapor through the ferrofluid seal assembly 88 and maintaining antechamber 90 in a very dry state.

Controller 95 may also pump antechamber 90 may also be pumped to rough vacuum via connection port 91. Because antechamber 90 is sealable from ambient conditions, antechamber 90 may be pumped to rough vacuum and sealed such that rough vacuum is maintained for the life of the x-ray tube.

Figure 5:
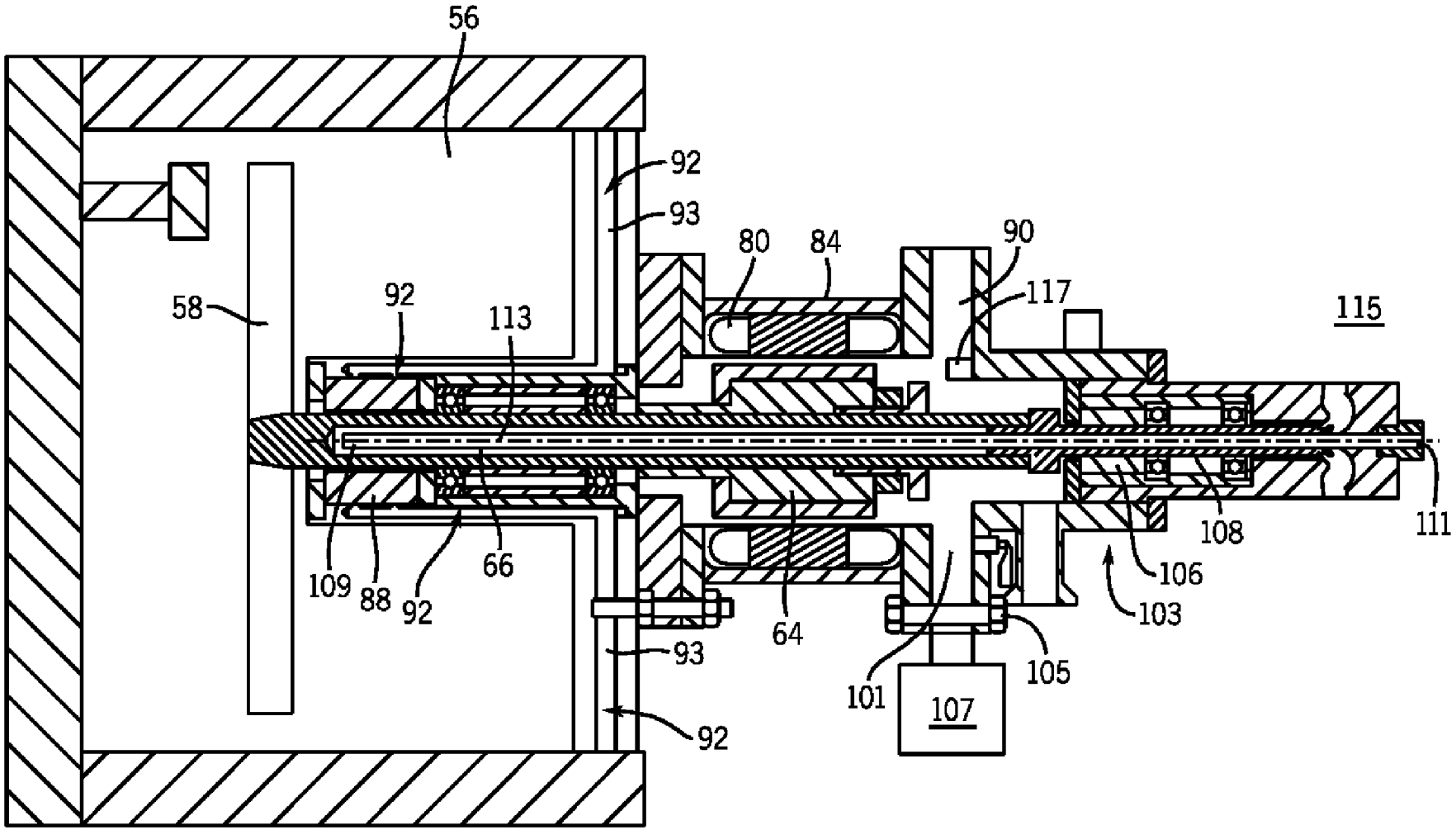
FIG. 5 illustrates a cross-sectional view of another embodiment of a ferrofluid seal assembly according to the present invention.

FIG. 5 illustrates a cross-sectional view of the x-ray tube 14 of FIG. 3 having an extended antechamber 101 according to another embodiment of the present invention. As shown, plate 82 of FIG. 4 is replaced with an antechamber assembly 103. Antechamber assembly 103 has a shaft 66 extending therethrough. Antechamber assembly 103 houses a second ferrofluid seal assembly 106 and a second bearing assembly 108 positioned to separate antechamber 90 from the ambient environment 115. Center shaft 66 extends through both ferrofluid seal assemblies 88, 106. In this manner, center shaft 66 extends from inside the x-ray tube volume 56, through extended antechamber 101 and through antechamber assembly 103, and into the ambient environment 115.

According to another embodiment of the present invention, the gas load which passes, or diffuses, from antechamber 101 through ferrofluid seal assembly 88 and into x-ray tube volume 56 is reduced by attaching a controller 107 to extended antechamber 101 via connection port 105, purging extended antechamber 101 and backfilling a relatively inert gas, such as nitrogen, argon, and the like, into extended antechamber 101 during, or subsequent to, assembly and processing. Alternatively, controller 107 may backfill dry air into extended antechamber 101. A dessicant 117 may be placed in extended antechamber 101 such that traces of water vapor present in extended antechamber 101 are absorbed, thereby reducing transfer of water vapor through ferrofluid seal assembly 88 and maintaining extended antechamber 101 in a very dry state.

In addition to coolant 93 cooling ferrofluid seal assembly 88 via coolant 93 flowing through cooling passage 92 as described above with respect to FIG. 3, coolant 111 may additionally be flowed into the center of center shaft 66. Cavity 113 has coolant feedline 109 positioned therein and passing coolant 111 therethrough. As such, coolant feedline 109 extends through the length of center shaft 66 to provide coolant to either ferrofluid seal assembly 88, second ferrofluid seal 106, or both.

Figure 6:
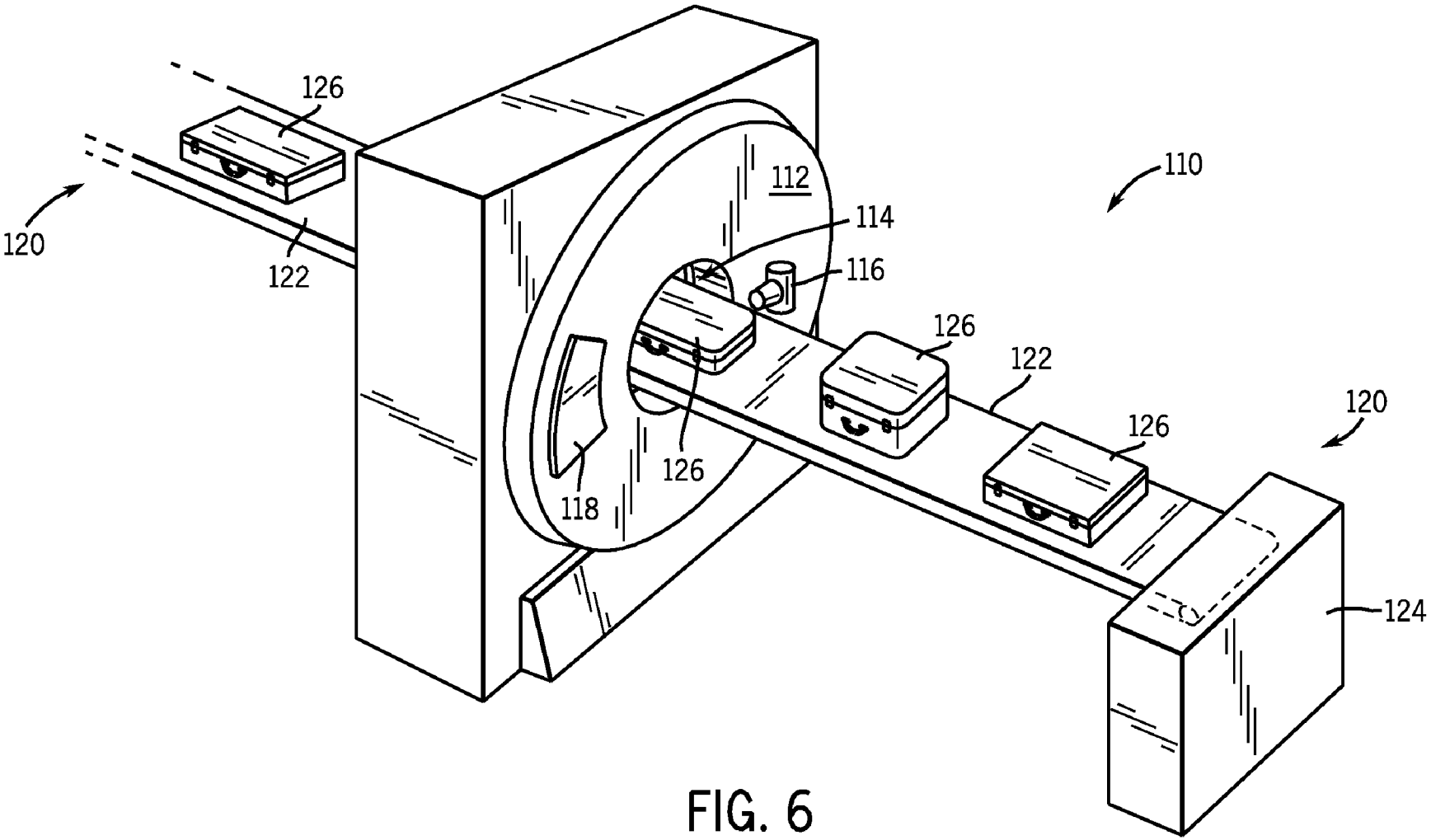
FIG. 6 is a pictorial view of a CT system for use with a non-invasive package inspection system.

FIG. 6 is a pictorial view of a CT system for use with a non-invasive package inspection system. Package/baggage inspection system 110 includes a rotatable gantry 112 having an opening 114 therein through which packages or pieces of baggage may pass. The rotatable gantry 112 houses a high frequency electromagnetic energy source 116 according to an embodiment of the present invention, as well as a detector assembly 118 having scintillator arrays comprised of scintillator cells. A conveyor system 120 is also provided and includes a conveyor belt 122 supported by structure 124 to automatically and continuously pass packages or baggage pieces 126 through opening 114 to be scanned. Objects 126 are fed through opening 114 by conveyor belt 122, imaging data is then acquired, and the conveyor belt 122 removes the packages 126 from opening 114 in a controlled and continuous manner. As a result, postal inspectors, baggage handlers, and other security personnel may non-invasively inspect the contents of packages 126 for explosives, knives, guns, contraband, etc. Additionally, such systems may be used in industrial applications for non-destructive evaluation of parts and assemblies.

Therefore, according to one embodiment of the present invention, a system for controlling a gas load imposed upon a high vacuum chamber comprises a first chamber enclosing a high vacuum and positioned within an ambient environment, a second chamber enclosing a gas and positioned within the ambient environment adjacent to the first chamber, and a rotatable shaft having a first portion extending into the first chamber and a second portion extending into the second chamber. A ferrofluid seal is positioned about the rotatable shaft and positioned between the first portion and the second portion and the ferrofluid seal separates the first chamber from the second chamber. A control unit is attached to the second chamber and configured to control the gas enclosed in the second chamber such that a gas load in the first chamber is reduced.

In accordance with another embodiment of the invention, an x-ray tube includes a vacuum enclosure having a high vacuum formed therein, an antechamber containing a gas, and a hermetic seal positioned between the vacuum enclosure and the antechamber. A rotatable shaft extends from within the vacuum enclosure and into the antechamber through the hermetic seal. A controller is fluidically connected to the antechamber and configured to adjust a pressure of the gas in the antechamber such that a gas load of the first enclosure is reduced.

Yet another embodiment of the present invention includes a method of manufacturing an x-ray tube comprising the steps of providing a rotatable shaft, attaching an anode to a rotatable shaft, disposing the anode in a first volume, attaching a rotor and a bearing assembly to the rotatable shaft, disposing the rotor and bearing assembly in a second volume, attaching a ferrofluid seal assembly to the rotatable shaft, positioned between the first volume and the second volume and hermetically sealing the two volumes from one another, attaching a controller to the second volume, the controller configured to control a gas contained in the second volume in order to reduce a gas load on the first volume, and forming an ultra-high vacuum in the first volume.

The present invention has been described in terms of the preferred embodiment, and it is recognized that equivalents, alternatives, and modifications, aside from those expressly stated, are possible and within the scope of the appending claims.

What is claimed is:

1. A system for controlling a gas load imposed upon a high vacuum chamber comprising:

a first chamber enclosing a high vacuum and positioned within an ambient environment;

a second chamber enclosing an inert gas and positioned within the ambient environment adjacent to the first chamber;

a rotatable shaft having a first portion extending into the first chamber and a second portion extending into the second chamber;

a multi-stage ferrofluid seal positioned about the rotatable shaft and positioned between the first portion and the second portion, the multi-stage ferrofluid seal fluidically separating the first chamber from the second chamber; and a control unit attached to the second chamber and configured to control the inert gas enclosed in the second chamber such that a gas load in the first chamber is reduced.

2. The system of claim 1 wherein a barrier is formed between the second chamber and the ambient environment.

3. The system of claim 1 wherein the rotatable shaft has a third portion extending into the ambient environment.

4. The system of claim 2 wherein the barrier is a ferrofluid seal positioned about the rotatable shaft and fluidically separating the second chamber from the ambient environment.

5. The system of claim 4 wherein the rotatable shaft has a coolant passage formed therein from the third portion through the second portion.

6. The system of claim 1 wherein the inert gas is one of nitrogen and argon.

7. The system of claim 1 further comprising a desiccant positioned in the second chamber.

8. The system of claim 1 wherein the second chamber is pumped to rough vacuum by the control unit.

9. The system of claim 1 further comprising:

an x-ray tube target attached to the first portion of the rotatable shaft; and a rotor and a bearing assembly attached to the second portion of the rotatable shaft.

10. The system of claim 1 wherein the multi-stage ferrofluid seal comprises:

a pole piece encircling the rotatable shaft;

a plurality of annular rings extending from one of the pole piece and the rotating shaft toward the other of the pole piece and the rotating shaft such that a plurality of gaps is formed between the plurality of annular rings and the other of the pole piece and the rotating shaft;

at least one magnet encircling the rotatable shaft and positioned such that the plurality of gaps is disposed in a magnetic field formed by the magnet; and a ferrofluid deposited in the plurality of gaps.

11. The system of claim 1 wherein the ambient environment comprises one of an environment within a CT gantry, an environment within a mammography scanner, an environment within a RAD scanner, and an environment within an x-ray system.

12. An x-ray tube comprising:

a vacuum enclosure having a high vacuum formed therein;

an antechamber containing a gas and a desiccant;

a multi-stage hermetic seal positioned between the vacuum enclosure and the antechamber;

a rotatable shaft extending from within the vacuum enclosure and into the antechamber through the multi-stage hermetic seal; and a controller fluidically connected to the antechamber and configured to adjust a pressure of the gas in the antechamber such that a gas load of the vacuum enclosure is reduced;

wherein the gas contained in the antechamber is relatively inert.

13. The x-ray tube of claim 12 wherein the multi-stage hermetic seal is a ferrofluid seal.

14. The x-ray tube of claim 13 wherein the gas is one of nitrogen and argon.

15. The x-ray tube of claim 12 wherein the controller is further configured to maintain the pressure of the gas in the antechamber at rough vacuum pressure.

16. The x-ray tube of claim 12 incorporated in one of a CT imaging system, a CT baggage scanner, and an x-ray imaging system.

17. The x-ray tube of claim 12 wherein the rotating shaft extends through a wall of the antechamber at an end of the antechamber opposite the multi-stage hermetic seal, and further comprising a ferrofluid seal configured to hermetically seal an ambient environment therefrom with the ferrofluid seal.

18. The x-ray tube of claim 17 wherein the rotating shaft has a coolant passage formed therethrough.

19. A method of manufacturing an x-ray tube comprising the steps of:

providing a rotatable shaft;

attaching an anode to the rotatable shaft;

disposing the anode in a first volume;

attaching a rotor and a bearing assembly to the rotatable shaft;

disposing the rotor and bearing assembly in a second volume;

attaching a ferrofluid seal assembly to the rotatable shaft, positioned between the first volume and the second volume and hermetically sealing the two volumes from one another;

attaching a controller to the second volume, the controller configured to control a gas contained in the second volume in order to reduce a gas load on the first volume; and forming an ultra-high vacuum in the first volume.

20. The method of claim 19 further comprising:

purging a gas from the second volume; and re-filling the second volume with a relatively inert gas.

21. The method of claim 19 further comprising:

purging a gas from the second volume; and re-filling the second volume with dry air.

22. The method of claim 19 further comprising the step of providing a desiccant in the second volume.

* * * * *